United States Patent [19]

Melin

[11] 4,415,541

[45] Nov. 15, 1983

[54] METHOD OF RECOVERING NICKEL FROM A SPENT FAT HARDENING CATALYST

[75] Inventor: Åke L. Melin, Oskarshamn, Sweden

[73] Assignee: SAB Nife AB, Landskrona, Sweden

[21] Appl. No.: 348,139

[22] Filed: Feb. 11, 1982

[30] Foreign Application Priority Data

Feb. 12, 1981 [SE] Sweden ..... 8100983

[51] Int. Cl.[3] ..... C01G 53/04; C01G 53/10; C11C 13/00; B01J 23/94

[52] U.S. Cl. ..... 423/140; 252/412; 252/413; 260/412.5; 260/418; 423/150; 429/223

[58] Field of Search ..... 252/412, 413; 260/409, 260/412, 412.5, 418; 423/150, 146, 140

[56] References Cited

U.S. PATENT DOCUMENTS

| | | | |
|---|---|---|---|
| 1,022,347 | 4/1912 | Wilbuschewitsch | 252/412 |
| 1,381,558 | 6/1921 | Hoskins | 423/150 |
| 3,640,897 | 2/1972 | Restaino | 252/412 |
| 3,752,706 | 8/1973 | Melin | 252/182.1 |
| 4,185,026 | 6/1980 | Smith et al. | 252/412 |

FOREIGN PATENT DOCUMENTS

| | | | |
|---|---|---|---|
| 55-115494 | 9/1980 | Japan | 260/412 |
| 49364 | 11/1918 | Netherlands | 252/412 |

*Primary Examiner*—P. E. Konopka
*Attorney, Agent, or Firm*—Laurence R. Brown

[57] ABSTRACT

The invention relates to a method of recovering nickel from a spent fat hardening catalyst which consists of finely divided nickel metal on a carrier for example of infusorial earth and/or synthetic material and suspended in fat. The fat is saponified by means of an alkali solution to form a dissolved soap composition which is separated from the nickel metal and the carrier. The nickel metal is then leached out from the carrier and recovered in the form of nickel sulphate. Soap can be salted out of the dissolved soap composition and be used for cleaning purposes in industry, and the carrier can be washed and re-used. During the recovery waste solutions from the alkaline accumulator industry may appropriately be used so that only sulphuric acid is needed as a process chemical. The nickel sulphate solution recovered can be used, for example, as a raw material for the production of active nickel hydroxide mass for alkaline accumulators.

2 Claims, 1 Drawing Figure

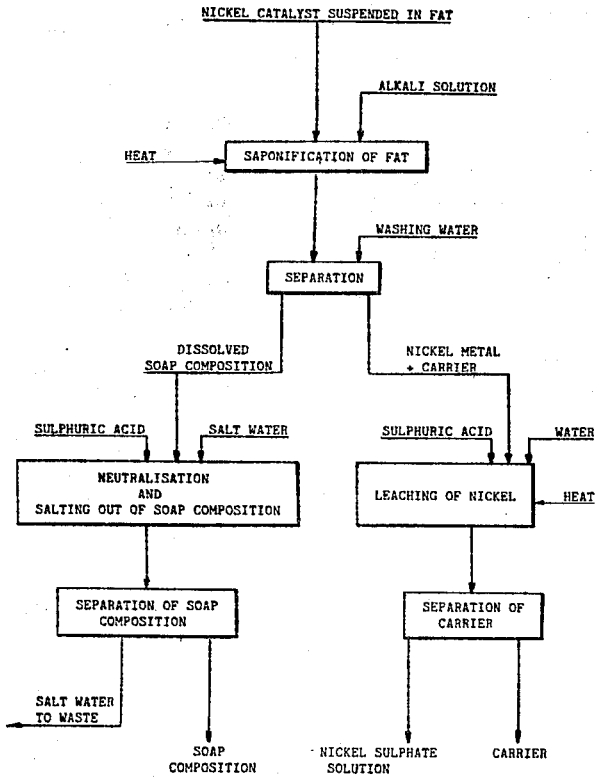

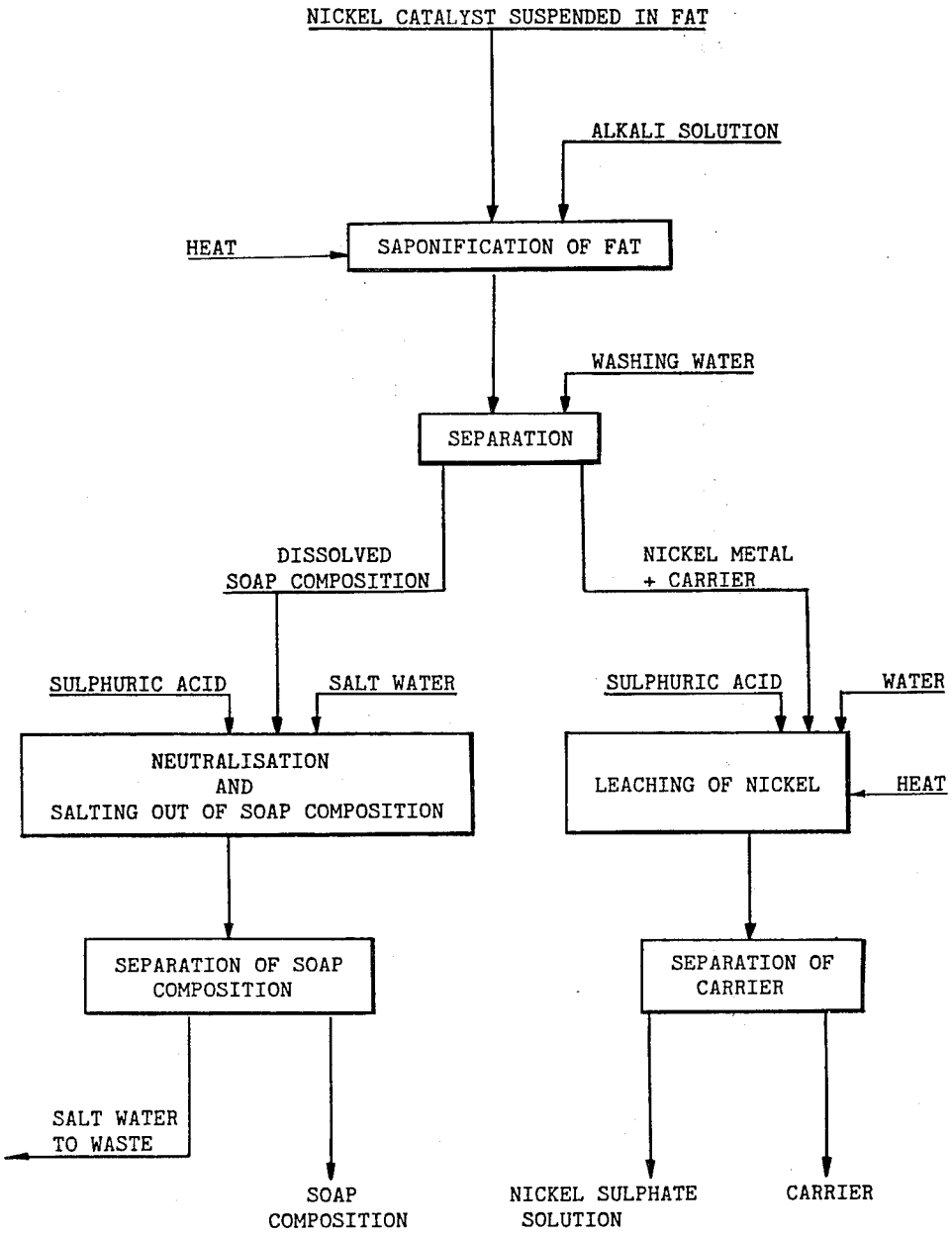
NICKEL CATALYST SUSPENDED IN FAT
ALKALI SOLUTION
HEAT
SAPONIFICATION OF FAT
WASHING WATER
SEPARATION
DISSOLVED SOAP COMPOSITION
NICKEL METAL + CARRIER
SULPHURIC ACID
SALT WATER
SULPHURIC ACID
WATER
NEUTRALISATION AND SALTING OUT OF SOAP COMPOSITION
LEACHING OF NICKEL
HEAT
SEPARATION OF SOAP COMPOSITION
SEPARATION OF CARRIER
SALT WATER TO WASTE
SOAP COMPOSITION
NICKEL SULPHATE SOLUTION
CARRIER

METHOD OF RECOVERING NICKEL FROM A SPENT FAT HARDENING CATALYST

TECHNICAL FIELD

The present invention relates to a method of recovering nickel from a spent fat hardening catalyst consisting of finely divided nickel metal on a carrier for example of infusorial earth and/or synthetic material and suspended in fat.

BACKGROUND ART

Nickel catalysts are used in various connections in the chemical industry. The effective component is finely divided nickel, but different fields of application require different carriers for the catalyst metal. Within the field of hydrogenation of fats, or fat hardening, which is used for producing the raw materials for manufacturers of margarine, edible oils and the like, catalysts which contain nickel metal on a carrier of for example infusorial earth are used to a large extent. The carrier may possibly be mixed with or replaced by a synthetic material, for example a polymer. Since the finely divided nickel metal is pyrophoric, the catalyst is used suspended in solid or liquid fat. A usual kind of such a catalyst generally contains about 20–25% nickel, about 10–15% infusorial earth or the like and about 60–65% fat, preferably of vegetable origin.

After being used for some time, the catalyst is spent or "poisoned" as it is customary to say. This may be, for example, because the catalyst is mixed with inorganic or organic impurities from the reaction material. As a result, the catalyst becomes unsuitable for further industrial use. Since the nickel metal included in the catalyst represents a considerable value, a simple and cheap method of recovering nickel from spent catalysts of the type in question has long been sought.

In the German work "Forschung und Entwicklung zur Sicherung der Rohstoffversorgung", published by the Bundesministerium für Forschung und Technologie, Bonn 1976, solutions hitherto proposed for recovering metal from this type of catalyst with a high content of organic components are given on page 90 et seq. It is stated that these solutions to the problem are based on calcining, grinding the residue from the calcining and wet chemical recovery of the metal. These methods are less suitable in practice, however, because during the calcining the catalyst carrier forms silicates or other compounds together with the metal, which compounds are very resistant to acids and therefore make the recovery of the metal more difficult and expensive. New methods of recovering catalyst metals for example nickel, are therefore being sought.

DISCLOSURE OF THE INVENTION

The present invention indicates a new method of preserving the nickel content in spent catalysts of the type stated above in an economically advantageous manner. This method is characterized in that the fat is saponified into a solution of soap composition by adding an alkaline aqueous solution to the fat hardening catalyst, then separating the nickel metal and the carrier from the solution of soap composition, after which the nickel metal is leached out of the carrier by means of sulphuric acid, nickel being recovered in the form of nickel sulphate solution.

For the saponification an alkaline aqueous solution consisting of contaminated alkali hydroxide solution from the preparation of electrodes in the accumulator industry may appropriately be used. This used and contaminated alkali hydroxide solution is not used otherwise but is neutralized and emptied out into the sewer after cleaning in a purifying plant.

The separated solution of soap composition may appropriately be neutralized and salted out by means of sulphuric acid and a salt solution, and neutralized and salted out by means of sulphuric acid and a salt solution, and the soap composition is separated from the solution. This soap composition can for example be used for cleaning purposes in industry. For the salting out a salt solution may appropriately be used which consists of a waste solution from the manufacture of nickel mass in the accumulator industry, purified of heavy metals by means of ion exchangers and mainly containing sodium sulphate dissolved in water. This solution is also a pure waste product which is normally emptied into the sewer.

Nickel or nickel compounds can be obtained from the nickel sulphate solution recovered. A suitable use for the nickel sulphate solution is as a raw material for the manufacture of active nickel hydroxide mass for alkaline electrical accumulators. Further information about how such a manufacture of mass can be carried out is found for example in the U.S. Pat. No. 3,752,706.

BRIEF DESCRIPTION OF THE DRAWING

The invention will now be described in more detail with reference to the accompanying flow chart.

DETAILED DESCRIPTION OF THE PREFERRED EMBODIMENT

The spent fat hardening catalyst is placed in a heated reaction vessel provided with agitator(s). An alkaline aqueous solution is added which may consist of potassium hydroxide or sodium hydroxide in solution, the fat content in the catalyst mixture being saponified into a dissolved soap composition. As previously mentioned, a spent alkali hydroxide solution from the preparation of electrodes in the accumulator industry may appropriately be used for the saponification. Since this solution would normally otherwise be neutralized and destroyed, this process chemical is obtained practically free. The impurities which are found in the solution are not of such a kind that they influence the recovery of nickel from the fat hardening catalysts.

The dissolved soap composition from the reaction vessel is separated in a filter or a centrifuge from the components which are still solid and which form a residue of finely divided nickel metal and carrier. This residue is washed with water and suspended in water in a reaction vessel, where nickel is leached out by means of sulphuric acid with agitation and heating up to about 60°–90° C. The leaching out may possibly be effected in a plurality of stages for a better yield of nickel.

The nickel, which is now dissolved to form an aqueous solution of nickel sulphate, is separated from the carrier in a filter or a centrifuge. The carrier is washed and can then be re-used. A suitable use for the carrier is for example as a filter aid in the recovery of nickel and cadmium from scrap or manufacturing waste in the alkaline accumulator industry.

The nickel sulphate solution obtained can be used for the production of metallic nickel, for example for re-use as catalysts. It can also advantageously be used as raw material for the manufacture of nickel hydroxide mass for alkaline accumulators. In the U.S. Pat. No. 3,752,706 it is described how such masses can be produced by continuous precipitation with nickel sulphate as the starting point, but also how the same production can be effected by older methods in batches.

The saponified and filtered fat solution is collected in a reaction vessel where it is neutralized by adding sulphuric acid, and in addition a salt solution is added for salting out and precipitation of soap composition. The salt solution may appropriately consist of a waste solution from the production of nickel mass in the accumulator industry, which has been purified of heavy metals by means of ion exchangers. The solution contains mainly neutral sodium sulphate. Since this solution cannot normally be re-used in the manufacture of accumulators, this process chemical is also obtained practically free.

The soap solution formed is separated and can then be used for cleaning purposes. The filtrate contains mainly alkali sulphates and can be poured down the drain after possible purification.

As has been shown, the process can be carried out with very simple and cheap chemicals. If waste solutions from the accumulator industry are used as described above, only fresh sulphuric acid need be added. Apart from the recovery of nickel, there is also the possibility of utilizing the other components in the original spent catalyst mixture. The process can therefore be carried out at low cost. It also solves a difficult environment problem as a result of the fact that the spent catalyst mixtures can be rendered harmless in a rational manner.

EXAMPLE

In order to examine the effectiveness of the method, a sample of a spent nickel catalyst mixture was heated together with a waste solution of potassium hydroxide with a specific weight of 1.17° to 70° C. The composition of the sample was about 25% nickel, about 10% infusorial earth and about 65% fat. When the fat in the sample had been saponified, the sample was filtered, a filter cake of nickel and infusorial earth being obtained together with a filtrate consisting of soap solution. The filter cake was washed and suspended with some water. Then the filter cake was leached out with dilute sulphuric acid at a temperature of 70° C. The consumption of acid was measured at 0.4 l of concentrated sulphuric acid per kg of filter cake. The solution was filtered and the nickel recovered was determined as 96.4% of the original nickel content of the sample. The soap solution was treated with 5% sulphuric acid, soap flakes being precipitated. The acid consumption was 2 liters of 5% acid per kg of the original sample. The solution was filtered, soap remaining over as a filter cake.

I claim:

1. A method of recovering nickel from a spent fat hardening catalyst consisting of finely divided nickel metal on a carrier material and suspended in fat, characterized in that the fat is saponified into a solution of soap composition by adding an alkaline aqueous solution consisting of the waste product of contaminated alkali hydroxide solution from the preparation of electrodes in the accumulator industry to the fat hardening catalyst, then separating the nickel metal and the carrier from the solution of soap composition, after which the nickel metal is leached out of the carrier by means of sulphuric acid, nickel being recovered in the form of nickel sulphate solution and the separated solution of soap composition is neutralized and salted out by means of sulphuric acid and a salt solution and the soap composition is separated from the solution as a product, the method being an improved industrial process using chemical waste materials as primary chemical reactants characterized in that the salt solution used consists of waste solution from the product of nickel mass in the accumulator industry which has been purified of heavy metals by means of ion exchangers and which mainly contains sodium sulphate dissolved in water.

2. A method as claimed in claim 1, characterized in that the nickel sulphate solution recovered is treated for the production of active nickel hydroxide mass for alkaline electrical accumulators.

* * * * *